United States Patent [19]

Fertier et al.

[11] Patent Number: 4,531,610

[45] Date of Patent: Jul. 30, 1985

[54] DEVICE ENABLING A LOAD TO BE BRAKED AND/OR HELD, NOTABLY AN ANTI-FALL SAFETY DEVICE

[75] Inventors: Marcel Fertier, Fontaine; Bernard G. Cuny, Saint Nuzier d'Uriage, both of France

[73] Assignee: Games, Uriage, France

[21] Appl. No.: 376,118

[22] Filed: May 7, 1982

[30] Foreign Application Priority Data

May 8, 1981 [FR] France ..... 81 09234

[51] Int. Cl.[3] ..... A62B 1/14

[52] U.S. Cl. ..... 182/5; 182/192

[58] Field of Search ..... 182/5, 3, 4, 6, 7, 8, 182/9, 71, 72, 240, 235, 10, 11, 190, 191, 192, 193; 188/65.1, 65.2, 65.3, 65.4

[56] References Cited

U.S. PATENT DOCUMENTS

| | | | |
|---|---|---|---|
| 289,304 | 11/1883 | Pealer | 182/193 |
| 394,109 | 12/1888 | Fowler | 188/65.5 |
| 432,045 | 7/1890 | Hill | 182/193 |
| 524,481 | 8/1894 | Fowler | 182/193 |
| 1,033,311 | 7/1912 | Gilloon | 182/5 |
| 2,933,157 | 4/1960 | Huber | 182/5 |
| 3,177,544 | 4/1965 | Murdock | 182/5 |
| 4,059,871 | 11/1977 | Swager | 182/5 |

FOREIGN PATENT DOCUMENTS

| | | | |
|---|---|---|---|
| 539551 | 6/1922 | France . | |
| 1517335 | 3/1968 | France . | |
| 2410482 | 6/1979 | France . | |
| 2448910 | 9/1980 | France . | |
| 6421 | of 1892 | United Kingdom | 188/65.4 |

*Primary Examiner*—Reinaldo P. Machado
*Assistant Examiner*—Alvin Chin-Shue
*Attorney, Agent, or Firm*—Owen, Wickersham & Erickson

[57] ABSTRACT

A device enabling a person's fall to be braked and/or held comprising a body (2) bounding a channel (3) inside which a bearing surface (4) is formed and a swivelling component (6) comprising opposite arms (7, 8) fitted so as to swivel inside the channel (3) of the said body opposite the said bearing surface (4), with the said rope running between the bearing surface (4) and the swivelling component (6), the said rope, when it is stretched taut, making the swivelling component (6) swivel so that the cam-shaped outer profile (9) of its arm (7) moves towards the bearing surface (4) and presses the rope against this bearing surface (4).

8 Claims, 6 Drawing Figures

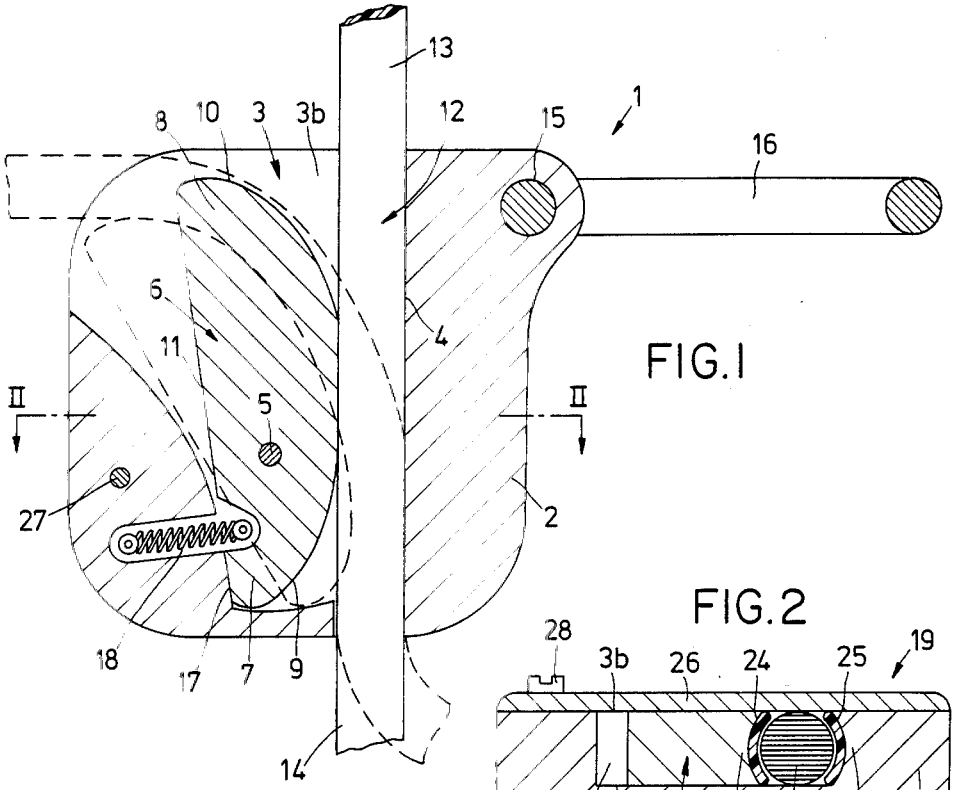
FIG.1
FIG.2
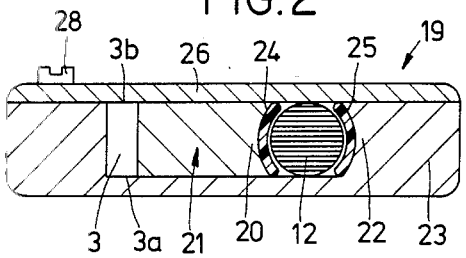
FIG.3
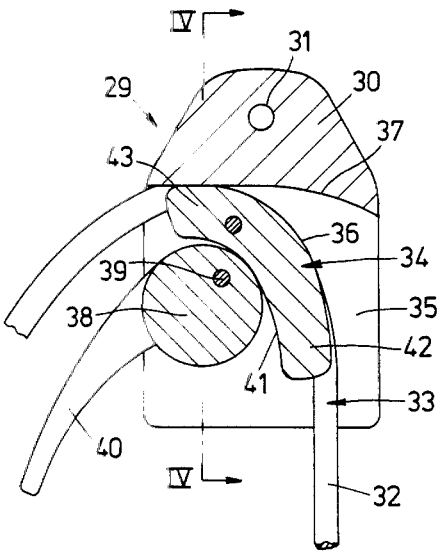
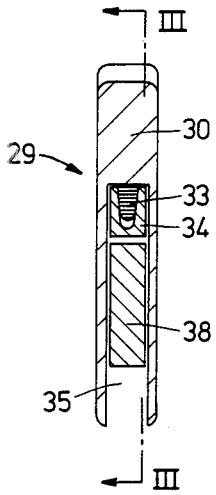
FIG.4

DEVICE ENABLING A LOAD TO BE BRAKED AND/OR HELD, NOTABLY AN ANTI-FALL SAFETY DEVICE

The present invention relates to a device enabling a load to be braked and/or held. This invention relates in particular to an anti-fall safety device that can be used by a person carrying out dangerous work.

Anti-fall devices are already known which use friction along a rope and pinching of this rope to immobilize the falling person. However, some of these devices require several ropes and several moving parts and they can be unlocked by the suspended person after he has fallen, so that these devices still do not provide full safety guarantees.

The purpose of the present invention is to remedy these drawbacks and propose a very simple system comprising few moving parts and not easy to operate by the person who has fallen and is still suspended in mid-air.

The device enabling a load, like a person, to be braked and/or held, notably forming an anti-fall safety device, applies friction along a rope and/or pinches this rope; this rope may be an ordinary textile or wire rope.

The device according to the present invention comprises a body which can be secured to a fixed point, or else to the load, having a channel through it, one wall of which forms a bearing surface; the rope passes through the channel in front of the bearing surface and has one side secured to the load or to a fixed point starting from one end of this channel. According to this invention the device also comprises a rope-engaging means which, under the effect of a sideways movement of the rope end and/or the body due to the tension of that end of the rope involved by the load, presses the rope between the bearing surface so braking and/or stopping the load by applying friction along and/or pinching the rope.

According to the present invention the rope-engaging means is installed to be movable on the body and deflects the taut side of the rope towards the bearing surface in such a manner that this rope-engaging means is subjected to the lateral force of the taut side and presses the rope against the bearing surface under the effect of this force.

According to the present invention the rope-engaging means preferably comprises a first lever pivoted on the body and provided with an outer profile capable of pressing the rope onto the bearing surface when it swivels in the direction of this surface, and a second lever pivoted on the body and provided with an outer profile on which the side of the rope can act when it is taut so as to make it swivel in one direction, whilst this second lever can, when swivelling, act on the first lever to make the outer profile of the latter swivel in the direction of the bearing surface in such a way as to nip or pinch the rope.

According to the present invention the outer profile of the first lever is preferably shaped like a cam which extends in the opposite direction to the rope side so that the greater the tension of that side of the rope the tighter the nip on the rope between the outer profile of this first lever and the bearing surface.

According to this invention the levers preferably make up a single part pivoted on the body and comprising, as first and second levers, a first arm and a second arm opposite to each other which extend along the bearing surface and which have a cam-shaped profile on the side of this surface, with the rope side, when it is taut, being able to act on the second lever of the single part in a direction which takes it away from the bearing surface, whilst its first arm presses the rope against the bearing surface.

According to this invention the device may comprise a return spring acting on the first lever, or the first arm, in a direction which moves its outer profile away from the bearing surface.

According to this invention the device may comprise a cam fitted with a handle and acting on one of the levers or arms so as to move the outer profile of the first lever or first arm away from the bearing surface thus releasing the rope.

According to this invention the device is preferably fitted with a cover mounted to swivel on the body and giving access to the channel to enable the rope to be installed facing the bearing surface; this cover comprises an orifice which, when it is in the closed position, is opposite a securing hole designed in the body so that the rope-engaging means provided for securing the body pass through the hole in it and the cover orifice so maintaining the cover in the closed position.

In a different embodiment the device according to this invention, enabling a load like a person to be braked and/or held, notably forming an anti-fall safety device, comprises a body having two roughly parallel channels separated by a centre part which forms a bearing surface in each channel, with the rope passing through these channels in front of these bearing surfaces and forming a loop on one side of the channels which passes round this centre part and has on the other side of the channel two ends, one of which is secured to a fixed point and the other to the load. According to this embodiment the device also comprises two components pivoted on the body and placed each opposite one of the bearing surfaces and each comprising a first arm and a second arm opposite each other which extend along the corresponding bearing surfaces and which have, on the side of this bearing surface, a cam-shaped outer profile or contour so that when the load stretches the rope tight, the sides of the rope come approximately in line and act sideways respectively on the second arm of the components and make these components swivel in opposite directions so that their first arms act on the rope in order to press it against the corresponding bearing surface of the centre part thus braking and/or holding the load.

In this variant the centre part may consist of a component mounted so as to swivel on the body.

In this variant the device may comprise a casing inside which the loop can spread out.

According to this invention the body may comprise a surface forming a stop and designed to limit the movement of the first lever or first arm away from the bearing surface.

According to the present invention the cam-shaped outer profiles are preferably made as the continuation of each other, with the radius of these cams increasing with increasing distance from the bearing surface.

According to this invention the cam-shaped outer profiles and/or the bearing surface may have a V-shaped cross-section facing the rope.

According to this invention the cam-shaped outer profiles and/or the bearing surface may be covered with an anti-friction material.

This invention will be more clearly understood on studying the anti-fall or fall arrester safety devices described as non-restrictive examples and illustrated by the drawings in which:

FIG. 1 shows a medial cross-section of a first anti-fall device with flat bearing surfaces;

FIG. 2 shows a section along II—II of FIG. 1, but with bearing surfaces coming in the form of grooves;

FIG. 3 shows a cross-section along III—III of FIG. 4, another embodiment of the device shown in FIG. 1;

FIG. 4 shows a transverse cross-section along IV—IV of the device according to FIG. 3;

Figure 5:
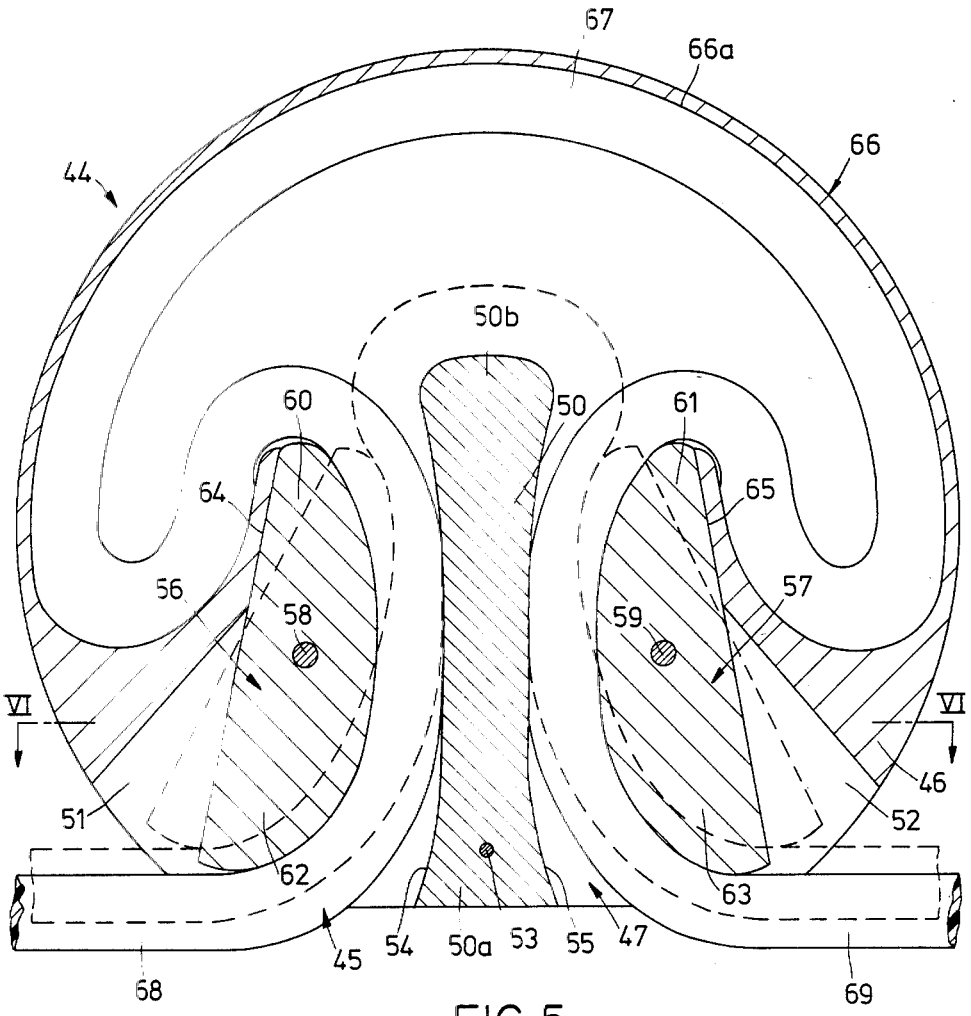
FIG. 5 shows a cross-section of another anti-fall device.

It can be seen in FIG. 1 that the anti-fall device marked overall by reference number 1 comprises a body 2 having a channel 3 in it opening out on either side of the body 2. This channel has a roughly flat wall or bearing surface 4 which extends from one end of the channel 3 to the other and the two parallel walls 3*a* and 3*b* which extend from wall 4 and are perpendicular to the wall 4.

A component 6 is placed between the walls 3*a* and 3*b* of the channel 3 at a certain distance from the wall 4 and is mounted on the body 2 by means of a pin 5 so as to swivel and slide over the walls 3*a* and 3*b* of the channel 3. This component 6 has two opposite lever arms 7 and 8 which extend along the wall 4. The outer profiles 9 and 10 of the arms 7 and 8 facing the wall 4 are shaped like cams which lie in line with each other and their radii increase with increasing distance from wall 4 whilst its back face 11 is roughly flat. In the example shown arm 8 is longer than arm 7.

Between component 6 pivoted on body 2, and wall 4 there runs a rope 12 which has a side or section 13 outside the channel 3 and continuing on the side of arm 8 of component 6, and a section 14 which continues on the side of arm 7 of this component 6.

On the other side of wall 4 of the channel 3 the body 2 has a securing hole 15 which is fitted with a securing ring 16.

Assuming the ring 16 is held stationary, if rope section 13 is pulled, this side of the rope will tend to line up with the securing ring 16 and the rope will wind round the cam-shaped outer profile of lever 8. Owing to the tension in rope 13 the component 6 will swivel so that its arm 8, forced sideways by section 13 of rope 12, will move away from wall 4 and the cam-shaped profile 9 of its opposite arm 7 will move nearer to wall 4. The rope 12 is therefore ultimately pinched between the cam-shaped outer profile of the arm 7 and the wall 4 acting as a bearing surface. Broken lines are used in FIG. 1 to show the position of the rope 12 and component 6 when side 13 of the rope is stretched taut, and said central part end portion which acts as an end-of-fall stop. The greater the tension in rope section 13, the greater the pressure on the rope 12 exerted by arm 7 of component 6.

If the device 1 shown in FIG. 1 is used as an anti-fall device it can be secured in two ways. Thus its body 2 can be secured to a fixed point by means of the ring 16 and, if need be, a rope fixed to this ring and rope section 13 secured to the person. But it is also possible to secure the section 13 of rope 12 to a fixed point and secure the person to the body 2 by means of the ring 16 and a rope fixed to this ring. If the person falls, the rope section 13 and the ring 16 will line up and the rope 13 will act sideways on the cam-shaped profile 10 of arm 8 of component 6 and make this component swivel in such a way that its opposite arm 7 will move nearer to the bearing surface 4 and pinch the rope as was seen above. During the fall the rope 12 will slip between the cam-shaped profile 9 of arm 7 and the bearing surface 4 and finally be held. The person's fall will therefore be absorbed fairly smoothly and then halted.

It is easy to see that the slip length and the pinching force on the rope between arm 7 and the bearing surface 4 depend on the respective lengths of the lever arms 7 and 8 and on the shape of the cam-shaped profile 9 of arm 7 as well as on the weight of the person.

Furthermore, the component 6 can be fitted onto the body 2 in such a way that the rope 12 is slightly pinched between the component 6 and the bearing surface 4 so as to hold it in a certain position when its side 13 is not taut.

In the example shown in FIG. 1 the body 2 comprises in the channel 3 a surface forming a stop 17 on which the back wall 11 of arm 7 bears so restricting the movement of arm 7 away from the bearing surface 4. This stop 17 can be positioned in such a way that the cam-shaped profile 9 of arm 7 of the component 6 presses the rope 12 onto the bearing surface 4 even when side 13 of the rope is not pulled taut.

Furthermore, between arm 7 of component 6 and the body 2 a spring 18 is installed which forms an elastic component returning arm 7 to the stop 17.

FIG. 2 shows a section view of another embodiment of the device 1 shown in FIG. 1. In this embodiment the device marked as a whole by reference number 19, operates in the same way as the one shown in FIG. 1, but differs from it in that the cam-shaped outer profile 20 of its swivelling component 21 and the bearing surface 22 of its body 23 have a cross-section shaped like an arc of a circle and in that the outer profile 20 and the bearing surface 22 are covered with linings 24 and 25 also shaped like an arc of a circle and made of anti-friction material. Thus the friction action of the rope 12 on the component 21 and on the body 23 can be increased.

As can be seen in FIG. 2 the devices shown in FIG. 1 and in FIG. 2 comprise a cover 26 giving access to the channel 3 so that the rope 12 can be placed between the swivelling component and the bearing surface without it being necessary to thread it in by one of its ends. This cover 26 has the same outline as the body 2 or the body 23 and is fitted on these bodies in such a way that it can swivel on itself round a pin 27 which can be seen in FIG. 1 and comprises, for example, a screw whose head 28 can be seen in FIG. 2.

The cover 26 contains an orifice or hole not shown in the drawing which is formed to correspond with hole 15 in the body 2 when it is in the closed position. In this way the ring 16 passes through the hole 15 in body 2 and the hole in the cover 26 so that, when the device is assembled, it is impossible to move the cover 26 which is locked in position by the ring 16.

The device shown in FIGS. 3 and 4 and marked overall by reference number 29 works in the same way as device 1 shown in FIG. 1. The design of this device 29 is, however, more suited to conditions in which its body 30 is secured by means of its hole 31 to a fixed point and the side 32 of the rope 33, corresponding to side 13 of rope 12 installed in the device in FIG. 1, is secured to the person.

This device 29 differs from the device 1 shown in FIG. 1 mainly in the fact that its swivelling component 34 fitted inside the channel 35 of the body 30 has a cam-shaped outer profile 36 extending opposite the bearing surface 37. As can be seen in FIG. 4, this outer profile 36 has a V-shaped cross-section, with the rope entering this V. The shape of this swivelling component enables the pinching effect on the rope to be increased since the rope is also pinched in the V.

Device 29 also differs from device 1 shown in FIG. 1 in that it is no longer fitted with return springs for the swivelling component 34 and in that a cam 38 is provided which is placed inside the channel 35 behind the swivelling component 34 and is fitted to swivel on the body 30 by means of a pin 39. This cam 38 is fitted with a handle 40 projecting outside the channel 35 so that it can be operated by hand.

When it swivels cam 38 can act on the rounded back face 41 of arm 42 of the swivelling component 34 corresponding to arm 8 of the swivelling component 6 of the device shown in FIG. 1 so as to make component 34 swivel in such a way as to move its other arm 43, corresponding to arm 7 of component 6 of the device shown in FIG. 1, away from the bearing surface 37. In this way it is possible, by manually turning cam 38, to act on the swivelling component 34 to release the rope 32 in a controlled manner. Thus a person attached to side 32 of the rope 33 can be brought down by letting this rope run between the swivelling component 34 and the bearing surface 37. In practice it is preferable for cam 38 and the back face of 41 of component 34 to be shaped so that, when the handle 40 is no longer being acted on, arm 43 of the swivelling component 34 presses the rope 33 against the bearing surface 37 under the action of the tension of side 32 of the rope 33 acting sideways on arm 42 of the swivelling component 34.

As can be seen in FIG. 4, the body 30 of device 29 is shaped like a pulley block between whose straps the swivelling component 34 and the cam 38 are placed. This device does not therefore need a cover since the rope can be placed in the channel 35 and the swivelling component 34 and the cam 38 can be fitted in this channel in succession.

Figure 6:
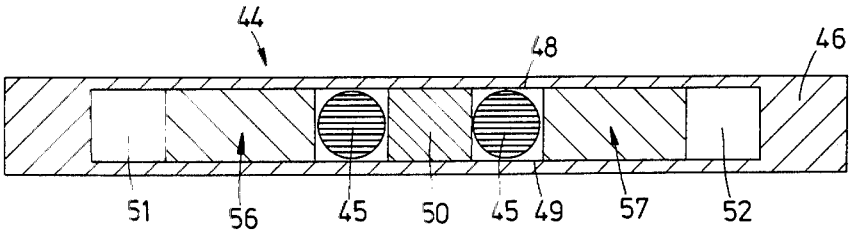
FIG. 6 shows a section along VI—VI of the device shown in FIG. 5.

FIGS. 5 and 6 show an anti-fall device marked overall by reference number 44 and differing from those described previously.

This device 44 is in fact designed to be placed along a rope 45 secured at both ends, as will be seen below.

Device 44 comprises a body 46 which is provided with a central passage 47 comprising two parallel walls 48 and 49. A centre component 50 is placed between walls 48 and 49 of passage 47 roughly along its centre line; this centre component 50 extends from one end of passage 47 to the other separating this passage into two channels 51 and 52 and is mounted to swivel on the body 46 by means of a pin located close to one end **50*a* of the centre component 50 so that this component 50 can swivel round this pin and slide over walls 48 and 49**.

In channel 51 and in channel 52 the centre component 50 comprises respectively a wall 54 and a wall 55 which are perpendicular to walls 48 and 49.

Components 56 and 57, which are assembled so as to be able to swivel around pins 58 and 59 by sliding over walls 48 and 49, are placed in channels 51 and 52 between walls 48 and 49 and opposite but at a distance from walls 54 and 55 of the centre component 50.

Components 56 and 57 are similar to component 6 of the device shown in FIG. 1 and comprise arms 60 and 61 corresponding to arm 7 and arms 62 and 63 corresponding to arm 8, with arms 60 and 62, 61 and 63 having outer profiles facing walls 54 and 55 respectively of the centre component 50, these outer profiles being cam-shaped.

The body 46 comprises surfaces 64 and 65 which form stops capable of limiting the movement of arms 60 and 61 respectively away from walls 54 and 55 of the centre component 50.

On the side of arms 60 and 61 of swivelling components 56 and 57 the body 46 is extended into a casing 66 which bounds a large space inside it, the thickness of which is at least equivalent to the distance separating walls 48 and 49 and which surrounds the other end **50*b* of the centre component 50 at some distance from it. In the example the end wall 66*a* of the casing 66** is an arc of a circle.

When device 44 is assembled to form an anti-fall device, the rope 45 is taken and a loop formed in it which is inserted into the casing 66 through the passage 47. This loop is fitted against the end inside wall **66*a* of the inside space of the casing 66 so as to form the largest possible reserve loop; the rope 45 comprises two sides or sections 68 and 69 at the ends of this loop lying outside device 44**.

Between rope sections 68 and 69 the centre component 50 is fitted onto the body 46 with its end **50*b* being positioned to point into the inside space of the case 66, and the swivelling components 56 and 57 are fitted into the body 46 in such a manner that the rope extends on one side between the cam-shaped profile of swivelling component 56 and wall 54 acting as the bearing surface of component 50 and on the other side between the cam-shaped outer profile of swivelling component 57 and wall 55 acting as the bearing surface of the centre component 50**.

During this assembly operation the back face of arms 60 and 61 of swivelling components 56 and 57 will come into contact respectively with the surfaces 64 and 65 acting as stops in the body 46; these surfaces 64 and 65 acting as stops converge towards the inside of the casing 66 to ease assembly.

It is possible by varying the dimensions or positions of the various parts of the device to provide for slight pressure on the rope 45 between the swivelling component 56 and wall 54 of the centre component 50 and between the swivelling component 57 and wall 55 of the centre component 50 so as to keep the reserve loop 67 at maximum size even when a slight pull is exerted on rope sides 68 and 69.

In order to use device 44 shown in FIGS. 5 and 6 all that is needed is to secure one of rope ends 68 and 69 to a fixed point and the other to the person involved.

If the person falls sides 68 and 69 of the rope 45 will be pulled into line and they will act on arms 62 and 63 of the swivelling components 56 and 57 pulling them apart, so that components 56 and 57 will swivel round their respective pivot pins 58 and 59 and their arms 60 and 61 will respectively move towards the bearing surfaces 54 and 55 so that the rope will be pinched tight between the cam-shaped outer profile of arm 60 and bearing surface 54 and between the cam-shaped outer profile of arm 61 and bearing surface 55 and the person's fall will be braked and/or absorbed, with the rope 45 slipping between the swivelling component 56 and the centre component 50 and between the swivelling component 57 and the centre component 50. Rope sections 68 and 69 will therefore increase in length at the expense of the loop 67.

At the end of the absorbed fall the loop of rope 45 spread out inside the casing 66 will reach its minimum size when it gets wound over the end 50*b* of the centre component 50; this end 50*b* also forms an end-of-fall stop and has a rounded shape.

In FIG. 5 the positions occupied by the rope 45 and the swivelling components 56 and 57 when the rope has reached the end of its travel are shown by broken lines.

In order to make it possible to re-use device 44 as an anti-fall device it has to be dismantled and assembled again as was laid down above.

The instant invention is obviously not limited to the examples described above. In fact it is possible to combine some of their features. It is also possible to alter their shape considerably. Although the surfaces of the said bodies and said cam-shaped components which the rope bears against are shown as smooth, it is nevertheless possible to provide asperities of any form on these surfaces so as to increase the friction action of the rope on the said surfaces. In addition the devices, notably according to FIGS. 1 to 4, can be used as anti-fall devices as described, but they can also be used as devices for holding in an adjustable preset position. Many other structure and application variants are possible within the scope of this invention.

We claim:

1. An anti-fall safety device for use with a rope enabling a load such as a person to be braked by friction against the rope and to be held by pinching the rope, comprising a body having attachment means for securing said body to something else, and having a rope-receiving channel, one wall of which forms a bearing surface along which the rope extends, a rope engaging lever pivoted to said body and having a first lever arm at one end and a second lever arm at its opposite end, said rope engaging lever extending along opposite said bearing surface, and defining with it said rope receiving channel, said first and second lever arms each having a cam-shaped outer profile facing said bearing surface and extending in line with each other, each said profile having a radius which increases with increasing length of its respective lever arm, a rope passing through said channel between said bearing surface and said rope-engaging lever, acting when stretched, on said second lever arm to cause it to swivel in a direction moving it away from said bearing surface and thereby causing said first lever arm to swivel towards said bearing surface, said rope-engaging lever being fitted onto said body in such a way that the rope, when not stretched, is slightly pressed between said rope-engaging lever and said bearing surface and in engagement with the zone of the smallest radii of said cam-shaped outer profiles, and the rope, when stretched, rests in continuous contact with said cam-shaped outer profiles of said first and second lever arms towards the ends thereof and the cam-shaped outer profile of the first lever arm presses and pinches the rope against said bearing surface.

2. An anti-fall safety device according to claim 1, wherein said body has another surface forming stop means positioned for limiting the movement of said first lever arm away from said bearing surface when the rope is not stretched.

3. An anti-fall safety device according to claim 2, having spring means acting on said rope-engaging lever in a direction which moves its first lever arm away from said bearing surface towards said stop surface.

4. An anti-fall safety device according to claim 1, wherein said second lever arm having a back face, said device having, in addition, a cam fitted with a handle and separately pivoted to said body, said cam bearing against the back face of the second lever arm of said pivoted rope-engaging lever so that when its handle is moved in one direction said cam moves said second lever arm towards said bearing surface and said outer profile of said first lever arm away from said bearing surface.

5. An anti-fall safety device for use with a rope enabling a load, such as a person, to be braked by friction against the rope, comprising:

a body having two approximately parallel channels separated by a central part having an end portion, said central part providing a bearing surface in each channel, so that rope may pass through said channels in front of said bearing surfaces, forming on one side of said channels a loop which surrounds said central part, while on the other side the rope provides two sections, one secured to a fixed point and the other secured to said load, which come approximately into line when said load stretches said part tight, two members pivoted to said body, each member being placed opposite one said bearing surface, the rope running between the pivoted members and the corresponding bearing surfaces, each pivoted member comprising a first lever arm and a second lever arm opposite each other extending along a corresponding bearing surface, said first and second lever arms of each member having respectively cam-shaped profiles facing the corresponding bearing surface, said cam-shaped profiles of each member extending in line with each other and having respectively radii which increase respectively with the length of the corresponding lever arms, said members being fitted onto said body in such a way that the rope, when not stretched, is slightly pressed between said members and said corresponding bearing surfaces and in engagement with the zones of smallest radii of said cam-shaped outer profiles thereof, said rope, when stretched, acting on the second lever arms of said members to cause them to swivel in directions moving them away from said bearing surfaces and thereby causing said first lever arms of said members to swivel towards said bearing surfaces so that their cam-shaped outer profiles press and pinch the rope against said bearing surfaces, said rope, when stretched, resting in continuous contact with said cam-shaped outer profiles of said members.

6. The device according to claim 5 wherein said body has two other surfaces forming stop means positioned respectively for limiting the movement of the first lever arms of said members away from said bearing surface when the rope, is not stretched.

7. The device of claim 5 wherein said central part is mounted to swivel on said body towards each member.

8. The device of claim 5 wherein said body comprises a casing which bounds a large space inside it, the rope extending inside this space so as to form a reserve loop surrounding said central part.

* * * * *

UNITED STATES PATENT AND TRADEMARK OFFICE

CERTIFICATE OF CORRECTION

PATENT NO. : 4,531,610

DATED : July 30, 1985

INVENTOR(S) : Marcel Fertier and Bernard G. Cuny

It is certified that error appears in the above-identified patent and that said Letters Patent are hereby corrected as shown below:

Column 6, line 25, "case 66" should read --casing 66--.

Column 6, line 37, "in the body" should read --on the body--.

Column 8, line 56, which is the last line of claim 5, after "members" insert --, and said central part end portion which acts as an end-of-fall stop--.

Signed and Sealed this

*Nineteenth* Day of *November 1985*

[SEAL]

*Attest:*

DONALD J. QUIGG

*Attesting Officer*

*Commissioner of Patents and Trademarks*